United States Patent [19]

Philp

[11] 4,135,173

[45] Jan. 16, 1979

[54] LOW VOLUME SHEET-WOUND TRANSFORMER COILS WITH UNIFORM TEMPERATURE DISTRIBUTION

[75] Inventor: Sanborn F. Philp, Pittsfield, Mass.

[73] Assignee: General Electric Company, Schenectady, N.Y.

[21] Appl. No.: 797,306

[22] Filed: May 16, 1977

Related U.S. Application Data

[63] Continuation-in-part of Ser. No. 686,289, May 14, 1976, abandoned.

[51] Int. Cl.[2] ..... H01F 27/28

[52] U.S. Cl. ..... 336/220; 336/223; 336/232

[58] Field of Search ..... 336/232, 222, 223, 220, 336/69, 70, 84

[56] References Cited

U.S. PATENT DOCUMENTS

| | | | |
|---|---|---|---|
| 3,210,706 | 10/1965 | Book | 336/223 X |
| 3,436,704 | 4/1969 | Keto et al. | 336/232 X |
| 4,012,706 | 3/1977 | Westendorp | 336/84 |

*Primary Examiner*—Thomas J. Kozma

*Attorney, Agent, or Firm*—Nathan D. Herkamp; Joseph T. Cohen; Leo I. MaLossi

[57] ABSTRACT

A sheet-wound transformer employing coils of thicker conductor in regions of higher eddy current losses and of thinner conductor in regions of lower eddy current losses exhibits improved temperature uniformity and lower total losses substantially without any increase in coil volume or weight compared to a conventional sheet-wound transformer.

6 Claims, 7 Drawing Figures

LOW VOLUME SHEET-WOUND TRANSFORMER COILS WITH UNIFORM TEMPERATURE DISTRIBUTION

INTRODUCTION

This application is a continuation-in-part of application Ser. No. 686,289, filed May 14, 1976, now abandoned.

This invention relates to transformers, and more particularly to a sheet-wound transformer coil exhibiting improved temperature uniformity throughout the coil substantially without any increase in coil volume or weight compared to a conventional sheet-wound transformer coil.

Eddy currents arise whenever electrical conductors are exposed to magnetic fields which change with time. Since the conductors have finite resistance, the currents induced by the fields cause heating within the conductors. The larger the surface area over which the magnetic flux can act, the greater is the induced current and the greater the energy lost in producing heat.

In conventional transformer practice, cross-sectional dimensions of wires to be used in the coils are limited in order to minimize losses due to eddy currents. Consequently, it is often necessary to employ a large number of wires, in parallel, to achieve the conductor cross section necessary to conduct normal load current. While eddy current losses in the winding conductor are a factor to be dealt with in a conventional (i.e., wire-wound) transformer design, the same is also true with respect to sheet-wound transformer coils of the type described in S. F. Philp application Ser. No. 618,459, now U.S. Pat. No. 4,039,990, filed Oct. 1, 1975 and assigned to the instant assignee. This is evident as pointed out in W. F. Westendorp application Ser. No. 638,613, filed Dec. 8, 1975, now U.S. Pat. No. 4,012,706, assigned to the instant assignee, and O. H. Winn application Ser. No. 638,612, now U.S. Pat. No. 4,021,764, filed Dec. 8, 1975 and assigned to the instant assignee.

According to Lenz's law, currents induced in a conductor by a changing magnetic field always flow in a direction which tends to establish a field opposing the field inducing them. For purposes of the present invention, Lenz's law may be reformulated as stating that induced (i.e., eddy) currents act to exclude magnetic flux from the interior of a conductor. The depth that magnetic flux may penetrate into the conductor (i.e., one skin depth) is a measure of the completeness of this exclusion. The skin depth $\delta$ depends only on frequency of the inducing field and the properties of the conductor. That is:

$$\delta = \sqrt{2\rho/\omega\mu}$$

where $\rho$ is specific electrical resistance of the conductor, $\omega$ is frequency in radians, and $\mu$ is magnetic permeability of the conductor. At 125° C., $\delta = 1.274$ centimeters in aluminum.

When the coils of a transformer are wound using sheet conductor (the sheet being of width equal to axial height of the coil), the patter of leakage flux or reactance flux (i.e., flux outside the iron core) is significantly different from what it would be in a wire-wound coil. In the wire-wound case, radial components of magnetic field are developed. If the coil wires are fine enough to make eddy currents negligible, there is no significant exclusion of magnetic flux from the coils.

In a sheet-wound coil of radial build of several centimeters or greater, radial components of magnetic field essentially do not develop therein because eddy currents are induced within the sheets, producing a field which tends to cancel such radial components. The net effect of the eddy currents becomes manifest only within the regions of about 2 skin depths below the broad surface of the sheet conductor at the upper and lower margins of the sheet conductor coil. Throughout the major portion of the conducting sheet, excepting only these margins at the edges, current distribution is essentially uniform. Thus the sheet-wound coil design permits eddy currents to develop substantially without impediment in the axial direction, while excluding radial components of field from the coils. In the radial direction, development of eddy currents is substantially prevented with little impediment to the axial components of field passing through the coil.

The net effect of the induced eddy currents becomes manifest over the aforementioned margins of the sheet. In general, these eddy currents flow in a direction to increase the current in the conductor; that is, they are in the same direction as the load current. The eddy currents are of greatest magnitude at the outermost and innermost turns, decreasing in magnitude to low values in the turns nearest the reactance gap between coils. The magnitude of these eddy currents significantly adds to the losses and thermal problems of the transformer.

Since heat generation (i.e., power per unit volume) is proportional to the square of the current density, a nonuniform distribution of current results in an even greater nonuniformity in heat generation. To what extent nonuniform temperature patterns result from the nonuniform heat generation depends on the details of coil construction and disposition of coil cooling ducts. In general, however, nonuniformities in current distribution lead to higher total losses than would be the case if the same total current were to flow in a more uniform distribution. This creates the possibility of making an alteration in the coil to diminish the overall effect of eddy currents.

Accordingly, one object of the invention is to provide a sheet-wound transformer exhibiting substantially uniform temperature distribution.

Another object is to provide a sheet-wound transformer in which overall thermal loss is reduced without requiring any increase in conductor material.

Another object is to provide a sheet-wound transformer in which losses due to edge currents are limited without modifications to the edges of the sheet windings.

Briefly, in accordance with a preferred embodiment of the invention, an electrical transformer comprises a magnetic core, and at least one winding adapted to be connected across first circuit means. The winding comprises an insulated, electrically-conductive sheet. The conductive sheet is wound continuously in a plurality of turns around the core. Each adjacent turn of the winding has one thickness within a predetermined radial distance from the core and a second, different thickness beyond the predetermined radial distance from the core, the thinner thickness being at least partially situated in a region of relatively low sheet-edge current density.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

DESCRIPTION OF TYPICAL EMBODIMENTS

Figure 1:
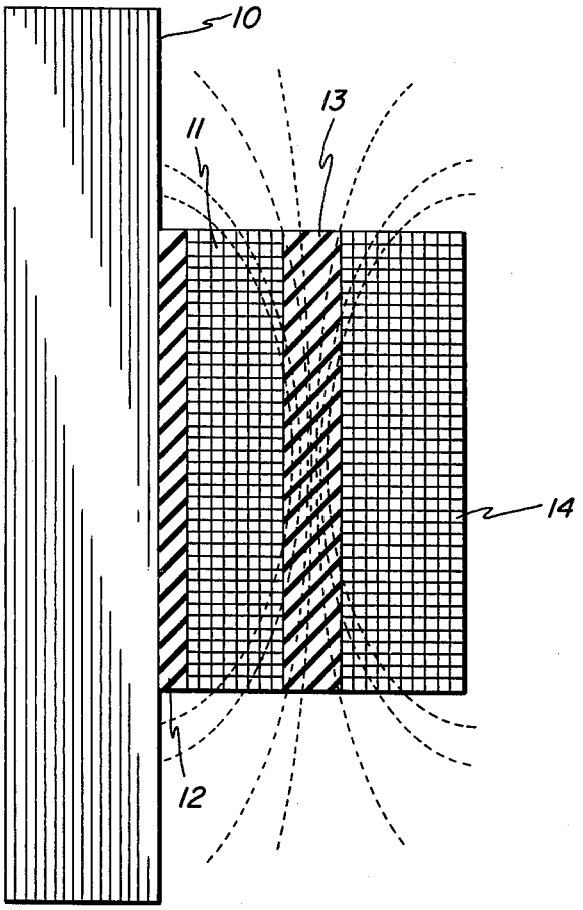
FIG. 1 is a partial, sectional view of a conventional wire-wound transformer, showing leakage flux paths therein.

In FIG. 1, a conventional wire-wound low-voltage winding 11 is illustrated encircling a laminated transformer core 10. This winding is comprised of a plurality of turns of insulated wire wound about a sheet of insulating material 12. A high-voltage winding 14, comprised of a plurality of turns of insulated wire, is wound about low-voltage winding 11 and electrically insulated therefrom by a sheet of insulating material 13 which forms the transformer reactance gap. Magnetic leakage flux, or reactance flux, indicated by dotted lines, tends to penetrate the wire turns near the axial edges of coils 11 and 14 since the coils are made of sufficiently fine wire to prevent development of eddy currents. Consequently, the eddy currents are of insufficient amplitude to establish a magnetic field opposing entry of the radial components of leakage flux into the wire-wound coil edges.

Figure 2:
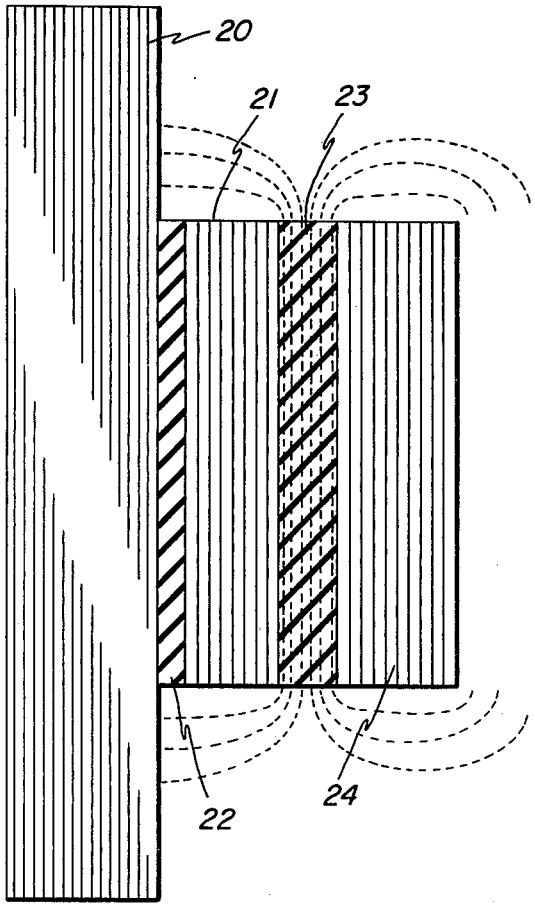
FIG. 2 is a partial, sectional view of a conventional sheet-wound transformer, showing leakage flux paths therein.

In FIG. 2, a conventional sheet-wound low-voltage winding 21 is illustrated encircling a laminated transformer core 20. This winding is comprised of a plurality of turns of insulated sheet conductor, such as aluminum, wound about a sheet of insulating material 22. A high-voltage winding 24, comprised of a plurality of turns of insulated sheet conductor, such as aluminum, is wound about low-voltage winding 21 and electrically insulated therefrom by a sheet of insulating material 23 which forms the transformer reactance gap. In this transformer, magnetic leakage flux, or reactance flux, shown as dotted lines, does not penetrate the sheet-wound turns near the axial edges of coils 21 and 24. This is because eddy currents are induced within sheet windings 21 and 24, creating a magnetic field tending to cancel the radial components of magnetic leakage flux which would normally penetrate the turns of a wire-wound tranformer as discussed in conjunction with the apparatus shown in FIG. 1. The net effect of the eddy currents becomes manifest only within regions about two skin-depths deep at the upper and lower margins of the coils of sheet conductor. Throughout the major portion of the conducting sheet, excepting only the upper and lower margins at the coil edges, current distribution is essentially uniform. Each of the aforementioned Westendorp U.S. Pat. No. 4,012,706 and Winn application Ser. No. 638,612 concerns ways of reducing ohmic losses at the sheet edges by modifying the edge regions or providing a low reluctance path outside the sheet edges.

For the apparatus of FIG. 2, the distribution of currents and magnetic fields may be calculated from the equations of electromagnetism, which involves solving the Maxwell equations. The results of this calculation indicate that the additional current (i.e., the edge current) flowing at the outer margins of the conducting sheet is not the same throughout the coil. The result, for a typical transformer, is depicted in FIG. 3.

Figure 3:
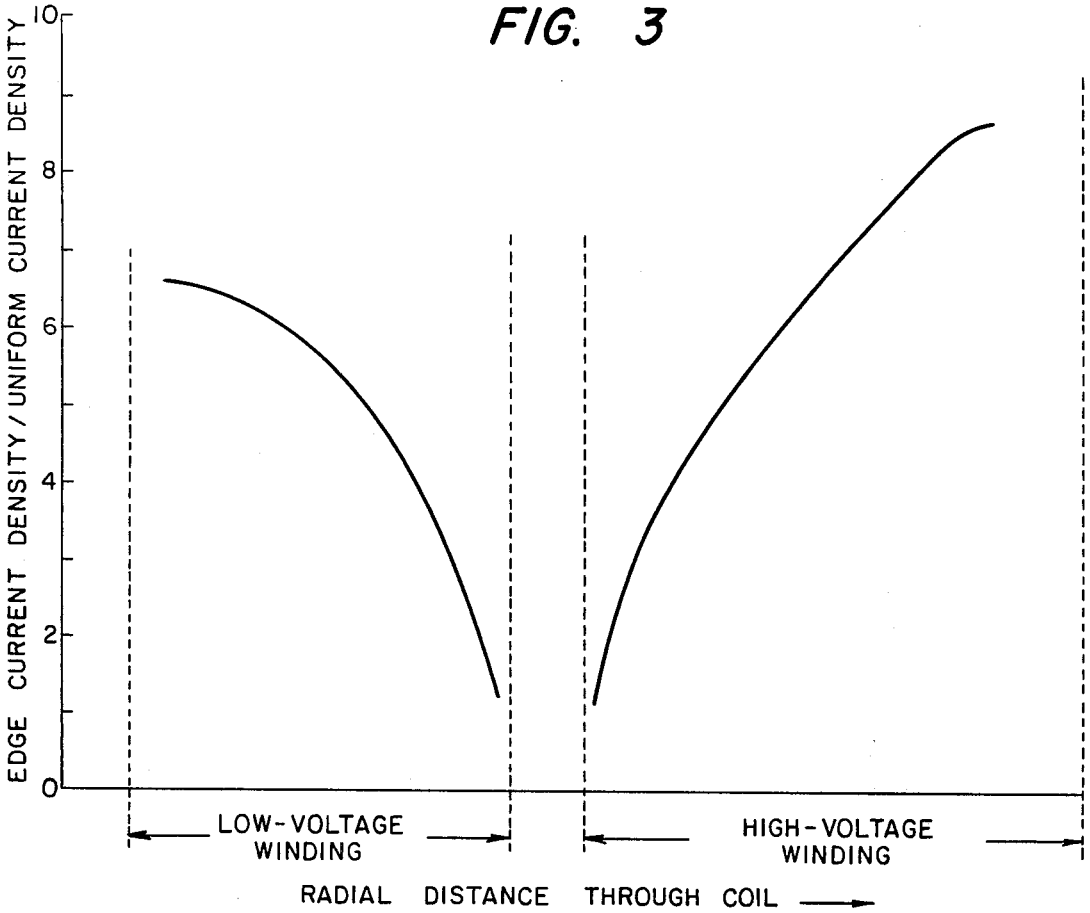
FIG. 3 is a graphical illustration of the variation of edge current density in the coils of a typical, conventional sheet-wound transformer, expressed in terms of the uniform current density in the bulk of the respective coils.

The curve of FIG. 3, which illustrates the ratio of edge current density to uniform current density in the bulk of the sheet-wound coils shown in FIG. 2, indicates that edge current is greatest at the radially-outermost turns of the outer or high-voltage winding and at the radially-innermost turns of the inner or low-voltage winding, and that magnitude of the edge current in each of the coils decreases to a respective minimum value in the turns nearest the reactance gap between the coils. Since heat generation (i.e., power per unit volume) is proportional to the square of the current density, a nonuniform current distribution, such as shown in FIG. 3, results in a much greater nonuniformity in heat generation. Moreover, current distribution nonuniformities in general lead to higher total heat losses than would be the case if the same total current flowed in a more uniform distribution.

Figure 4:
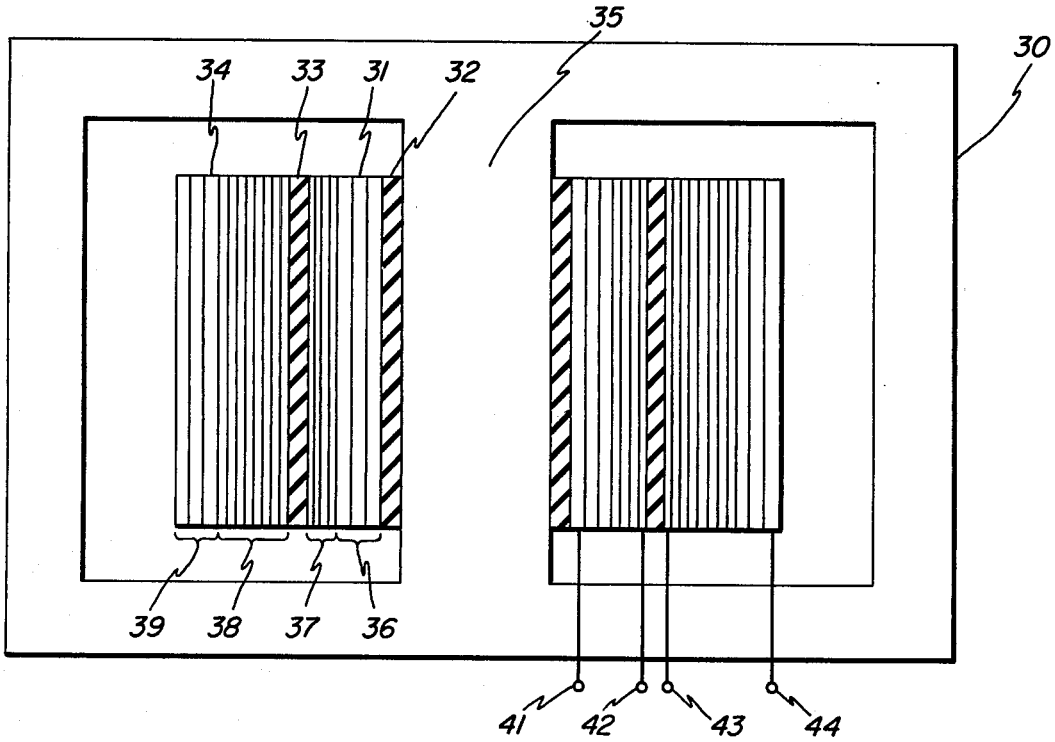
FIG. 4 is a cross-sectional side view of a single phase sheet-wound transformer constructed in accordance with the teachings of the instant invention.
Figure 5:
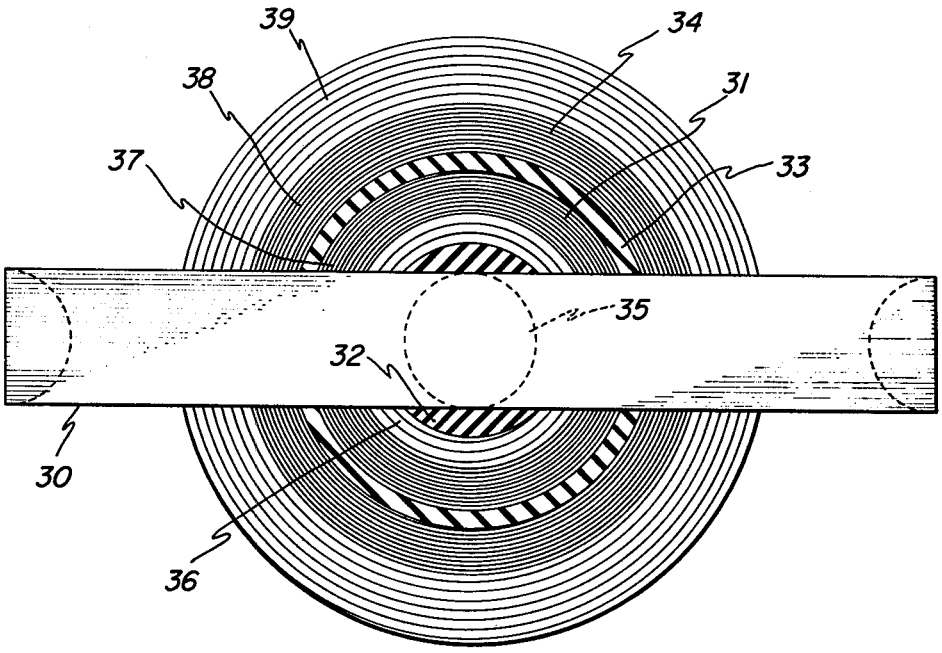
FIG. 5 is a top view of the apparatus of FIG. 4.

To overcome the heat problems associated with the apparatus of FIG. 2, a transformer of the type shown in FIGS. 4 and 5 may be employed. Use of thicker conductor will decrease losses due to edge currents, and will also decrease losses due to the bulk current in the sheet conductor. However, use of thicker sheet conductor in all or part of the windings will also increase the total amount of conducting material employed and thereby increase the weight and outside diameter of each coil in which thicker sheet conductor is employed. However, by using thicker sheet conductor in a fraction of the coil where edge current density is high, and thinner sheet conductor in the remainder of the coil, so that the total amount of sheet conductor used and the coil diameter are the same as for a coil of equivalent current and voltage rating having uniform conductor thickness throughout, such as shown in FIG. 2, a reduction in eddy current losses in the region where edge current density was high is achieved at the expense of a smaller increase in losses in the region where thinner sheet conductor is used.

FIGS. 4 and 5 illustrate a sheet-wound transformer comprising a laminated core 30 having a winding 31 adapted to be connected across first circuit means, such as a low voltage source (or load). Low voltage winding 31 is wound continuously about an insulating, inner cylinder 32 encircling center leg 35 of the core, and employs terminals 41 and 42 at either end thereof. A high-voltage winding 34, adapted to be connected across second circuit means such as a high voltage load (or source), is wound continuously about insulation means 33 which separates the high and low voltage windings and acts as a reactance gap in the transformer. Terminals 43 and 44 are connected to winding 34 at either end thereof. In both windings, each turn is insulated from the adjacent turn, preferably by polymer film insulation (not shown).

In low-voltage winding 31, it is evident that innermost turns 36 are of greater thickness than outermost turns 37. Similarly, in high-voltage winding 34, outermost turns 39 are of greater thickness than innermost turns 38. In this fashion, therefore, thicker sheet conductor is employed about core leg 35 only in the radially-inner and radially-outer regions of higher eddy current losses and thinner sheet conductor is employed about core leg 35 in the radially-central region of lower eddy current losses.

Although the embodiment shown in FIGS. 4 and 5 employs simply two different thicknesses of sheet conductor, more than two thicknesses may be employed. Use of a greater number of different sheet conductor thicknesses can further decrease the total eddy current losses in the coil. Wherever a thickness change is necessary, the sheet of desired thickness for the inner turns is wound for the desired number of turns and then cut. A coil of sheet of the new thickness is then welded to the turns already wound, and subsequent outer turns are wound onto the transformer from the coil of sheet of the new thickness. This operation may be repeated as many times as necessary.

Figure 6:
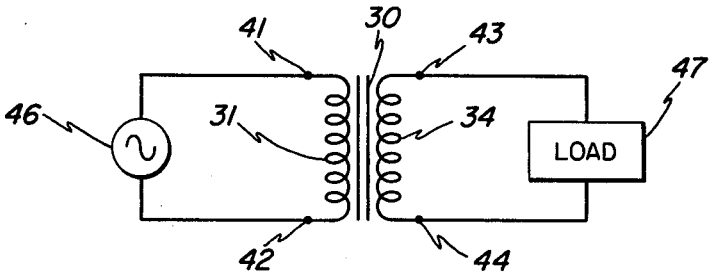
FIG. 6 is a schematic diagram of the transformer shown in FIGS. 4 and 5, connected in a circuit.

A schematic diagram of the transformer shown in FIGS. 4 and 5, connected in a circuit, is illustrated in FIG. 6, where like numbers signify like components. Thus a voltage source 46 is connected across primary winding terminals 41 and 42, and a load 47 is connected across secondary winding terminals 43 and 44, in a voltage step-up arrangement.

Figure 7:
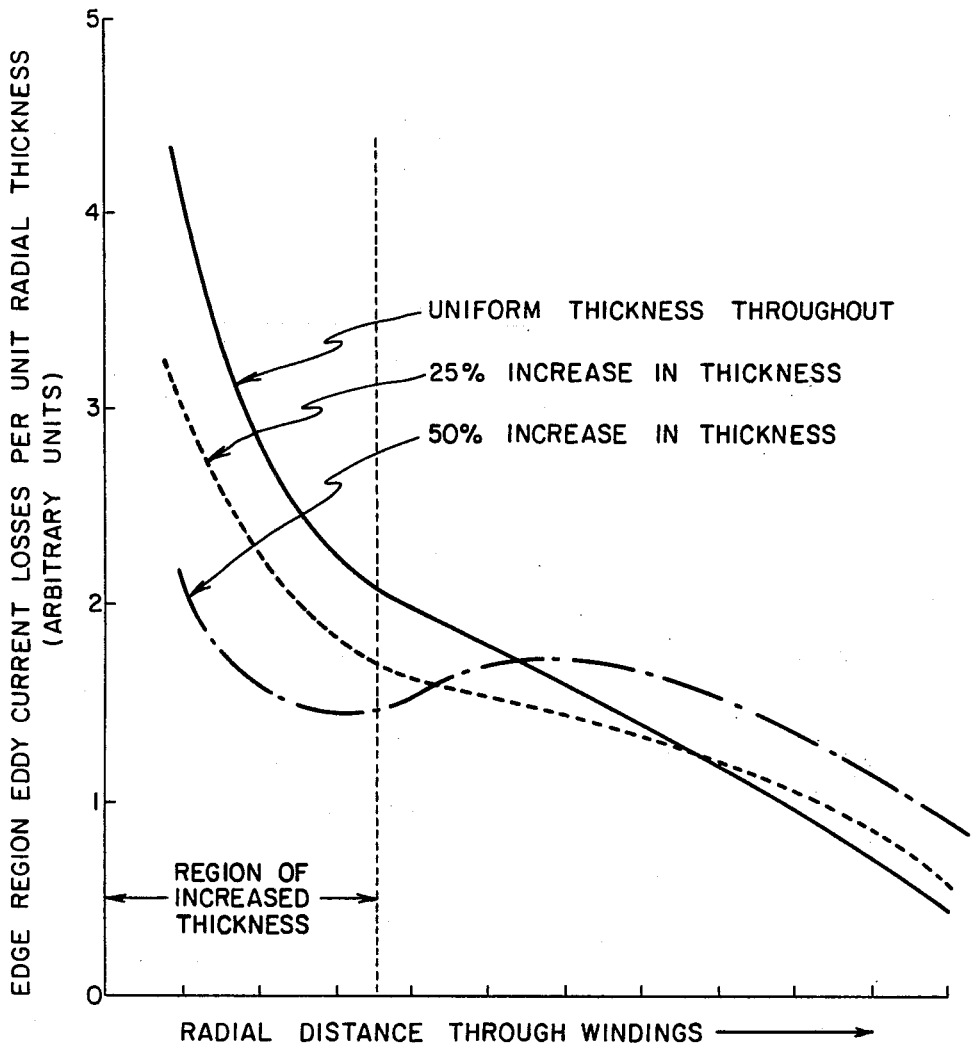
FIG. 7 is a curve illustrating the effect on edge current of two different redistributions of conductor material in a sheet-winding.

Examples of the improvement in distribution of edge current that may be achieved by use of the invention are illustrated in FIG. 7 for the simplest case of two different thicknesses of sheet conductor. While FIG. 7 applies only to the inner coil of a transformer, a similar result is obtainable by applying the invention to the outer coil of the transformer. For the coil with which FIG. 7 is concerned, conducting sheet thickness is increased by the indicated amount in the innermost quarter of the winding (i.e., one quarter of the radial distance through the winding). In the remaining portion of the winding, the conductor is made thinner so that total amount of conducting material and radial build are the same in all three instances illustrated. It can be seen that a 50% increase in conductor thickness in the innermost quarter of the winding results in a reduction in edge region eddy current losses at their highest point by a factor of about two, along with a marked improvement in uniformity of edge region eddy current losses per unit radial thickness of the coil. This results in a significant improvement in temperature distribution compared to that of a coil of the same size and weight but comprised of a single, uniform comductor thickness.

The foregoing describes a sheet-wound transformer exhibiting substantially uniform temperature distribution. The transformer achieves reduces overall thermal loss without requiring any increase in conductor material or modifications to the edges of the sheet windings.

While only certain preferred features of the invention have been shown by way of illustration, many modifications and changes will occur to those skilled in the art. It is, therefore, to be understood that the appended claims are intended to cover all such modifications and changes as fall within the true spirit of the invention.

I claim:

1. An electrical transformer having a magnetic core, a first winding adapted to be connected across first circuit means, said first winding comprising an insulated, conductive sheet wound continuously in a plurality of turns about the core, each adjacent turn of said first winding being of a first thickness within a first predetermined radial distance from said core and a second thickness smaller than said first thickness, beyond said first predetermined radial distance from said core, and a second winding adapted to be connected across second circuit means, said second winding comprising an insulated, conductive sheet wound continuously in a plurality of turns about said first insulated, conductive sheet, each adjacent turn of said second winding being of a third thickness within a second predetermined radial distance from said core and being of a fourth thickness larger than said third thickness beyond said second predetermined radial distance from said core.

2. The apparatus of claim 1 wherein said first and second thicknesses are each substantially uniform.

3. The apparatus of claim 1 wherein said first, second, third and fourth thicknesses are each substantially uniform.

4. An electrical transformer having a magnetic core, a first winding adapted to be connected across first circuit means, said first winding comprising a first insulated, conductive sheet wound continuously in a plurality of turns about said core, and a second winding adapted to be connected across second circuit means, said second winding comprising a second insulated, conductive sheet wound continuously in a plurality of turns about said first conductive sheet, said first and second conductive sheets being separated from each other by a reactance gap therebetween, each adjacent turn of said first and second conductive windings, respectively, being of a narrow thickness, respectively, in a first region close to said reactance gap and being of a greater thickness, respectively, in a second region, respectively, situated farther from said reactance gap than said first region.

5. The apparatus of claim 4 wherein each of said sheets, respectively, is of substantially uniform thickness in each of said first and second regions.

6. The apparatus of claim 1 wherein the first winding is separated from the second winding by an insulating means.

* * * * *